United States Patent [19]

Waterman et al.

[11] Patent Number: 4,496,129

[45] Date of Patent: Jan. 29, 1985

[54] TREE STAND

[75] Inventors: George W. Waterman, East Longmeadow; Arthur F. Dionne, Wilbraham, both of Mass.

[73] Assignee: Standex International Corp., Salem, N.H.

[21] Appl. No.: 446,947

[22] Filed: Dec. 6, 1982

[51] Int. Cl.[3] ..... A47G 33/12

[52] U.S. Cl. ..... 248/527; 47/40.5

[58] Field of Search ..... 248/527, 529, 150, 151, 248/165, 188, 523, 524, 525, 526; 47/40.5

[56] References Cited

U.S. PATENT DOCUMENTS

| | | | |
|---|---|---|---|
| 2,437,494 | 3/1948 | Anderson | 248/526 |
| 2,681,780 | 6/1954 | Santoro | 47/40.5 |
| 2,727,708 | 12/1955 | Lorenzen | 248/526 |
| 3,026,075 | 3/1962 | Phelon | 248/527 |
| 3,411,740 | 11/1968 | Schulz | 248/151 |
| 3,591,114 | 7/1971 | Beatly | 47/40.5 |
| 4,006,560 | 2/1977 | Schulz | 47/40.5 |

FOREIGN PATENT DOCUMENTS

| | | | |
|---|---|---|---|
| 545486 | 5/1942 | United Kingdom | 47/40.5 |

*Primary Examiner*—Reinaldo P. Machado
*Assistant Examiner*—Alvin Chin-Shue
*Attorney, Agent, or Firm*—Fishman & Dionne

[57] ABSTRACT

An improved tree stand for supporting and stabilizing a tree therewithin without the requirement of a trunk-encircling ring. The stand comprises a bowl and a plurality of legs, each leg carrying a trunk clamping screw at an inner end and received through one of a plurality of apertures provided in the bowl rim. Radially extending struts pivotally connected to the legs are urged into compressive engagement with a sidewall portion of the bowl by the engagement of the clamping screws with the trunk.

12 Claims, 4 Drawing Figures

TREE STAND

BACKGROUND OF THE INVENTION

This invention relates generally to stands for trees such as Christmas trees and the like and, more particularly, to such stands which require no trunk-encircling ring to restrain the inner ends of the stand's legs against outward movement as the trunk is clamped therebetween.

Perhaps one of the most well-known types of tree stands includes a bowl adapted to receive the trunk of the free therewithin, and a plurality of supporting legs which engage the bowl and, at inner ends thereof, engage a trunk encircling ring (canopy) through which trunk clamping screws are threaded, the ring preventing the outward movement of the leg inner ends as the clamping screws are tightened against the trunk. An example of such a tree stand is shown in U.S. Pat. No. 3,411,740 to Schuz. The provision of such a ring presents certain drawbacks. One such drawback is that the ring often requires that the lowermost branches of the tree be trimmed from the trunk to allow the trunk to pass through the ring. Removal of such branches is not only an inconvenience to the user but may detract from the appearance of the tree. Such rings also contribute to the cost of the stand, the labor required in assembling the stand, and limit the size of the tree trunk with which the stand may be used.

Recently, tree stands which require no trunk encircling ring have been developed. Typically, such stands employ legs which engage the bowl at rim and sidewall portions thereof. Inner ends of the legs are provided with trunk engaging screws which clamp the trunk therebetween, reaction forces on the legs from the engagement of the screws with the trunk pivotally urging the legs about the bowl rim into firm compressive engagement with the bowl sidewall. Examples of such ringless tree stands are found in U.S. Pat. Nos. 3,026,075 to Phelon et al and 4,006,560 to Schulz. While these stands do represent departures from certain of the drawbacks associated with ring-type stands, improved ringless stands have been sought. One area in which improvements have been sought is that of bowl structure. Ringless stands often require intricate ribs, flanges or other mounting surfaces on the bowl for adequate location and engagement of the legs with the bowl rim and sidewall. Similarly, such stands have required complex bowl engaging contours of the leg medial and inner end portions. Certain ringless stands such as that shown in the Schuz patent require links which join the inner leg ends with the bottom of the bowl. It will be appreciated that such complexities in stand structure may render the stand no more convenient to use than the prior art ring-type stands noted hereinabove and may in fact, render the stand more costly to manufacture than ring-type stands of similar capacity.

SUMMARY OF THE INVENTION

It is therefore a principal object of the present invention to provide a ringless tree stand which overcomes the deficiencies of the prior art.

It is another object of the present invention to provide such a stand characterized by simplicity in form of the component parts thereof.

It is another object of the present invention to provide such a stand characterized by an overall economy of structure and manufacture.

It is yet another object to provide such a stand characterized by convenience in assembly and use.

These and other objects which will become more readily apparent from the following detailed description taken in connection with the appended claims and accompanying drawing are achieved by the present invention which, in accordance with one aspect thereof, includes an improved pivotal engagement of the legs with the bowl rim at spaced apertures through which the legs are received. Such engagement of the legs and bowl rim obviates the need for providing these members with interengaging portions of complex shape. In accordance with another aspect of the present invention, the sidewall of the bowl is provided with a plurality of simple ears by which struts, connected to the legs are located in compressive engagement with the bowl sidewall. In accordance with yet another object of the present invention, the struts are pivotally connected with the legs for ease in assembly of the stand and compact storage thereof when the stand is disassembled. The legs and struts are of simple channel and U-shaped structure respectively for strength and economy of form.

DESCRIPTION OF THE PREFERRED EMBODIMENT

Figure 1:
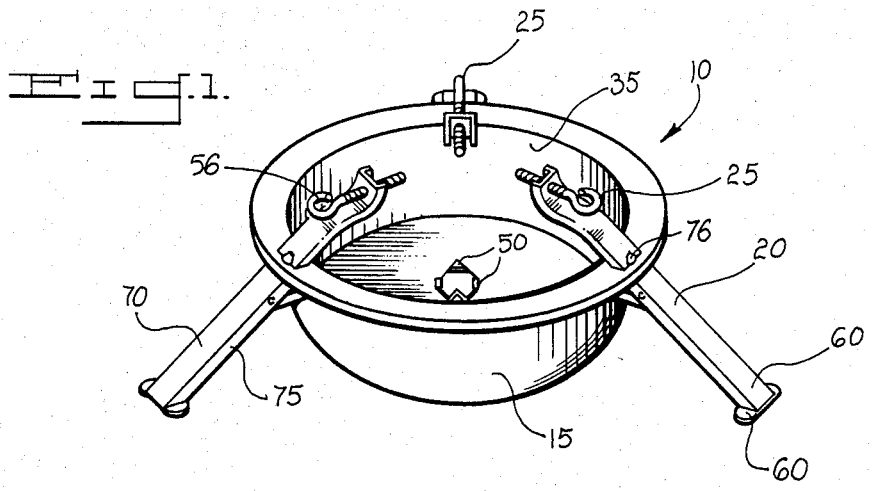
FIG. 1 is a perspective view of the tree stand of the present invention.
Figure 2:
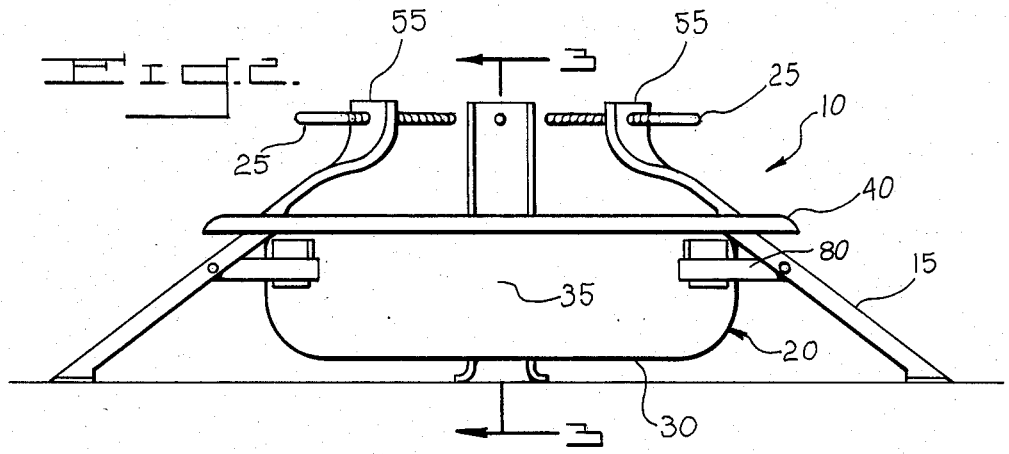
FIG. 2 is a side elevation of the tree stand illustrated in FIG. 1.

Referring to the drawing in general and particularly to FIGS. 1 and 2 thereof, the tree stand of the present invention shown generally at 10 comprises a bowl 15 adapted to receive the trunk (not shown) of a tree therewithin and a plurality of legs 20 which support the bowl and, by means of trunk clamping bolts 25 threaded into holes in the radially inner ends of the legs, vertically support and laterally stabilize the tree.

Bowl 15 is of a simple, unitary structure comprising a generally planar floor portion 30 and extending from the edges thereof, a smooth upstanding sidewall portion 35. Sidewall 35 terminates in a radially outwardly extending rim portion 40 apertured at spaced locations 45 thereon to receive legs 20 therethrough. The floor may, if desired, be provided with upstanding sharpened prongs or spikes 50 on which the bottom of the tree trunk may be impaled for enhanced maintenance of the vertical alignment of the tree. As shown, the prongs may comprise upturned corners of a rectangular plate secured to the bowl floor by any suitable technique appropriate for the materials employed.

Legs 20, received through apertures 45 in the bowl rim, extend upwardly and radially inwardly from the rim, terminating in inner end portions 55 which are provided with apertures through which clamping bolts 25 are threaded. As shown, the bolts may be provided with handles such as eyes 56 by which the bolts may be manually turned into compressive engagement with the tree trunk thereby clamping the trunk therebetween. Legs 20 also extend radially outwardly and downwardly, terminating in outer end portions 60 including enlarged feet 65 which support the stand on a horizontal surface such as a floor, platform or the like.

The legs are economically formed from generally straight channel stock having a simple upward bend at the inner end portion. The channel stock includes a central web portion 70 and generally parallel sidewall portions 75 bent downwardly from the edges of the web. The web may be provided with a raised detent 76 thereon and the radially inner and outer portions of the lower sidewall edges may be laterally offset as at 77 to define a notch, the detent and notch providing enhanced retention of the legs within apertures 45 as the clamping bolts are tightened against the tree trunk. It will be appreciated that channel shape of the legs prevents excessive radially outward deformation thereof as bolts 25 are tightened against the trunk.

Figure 4:
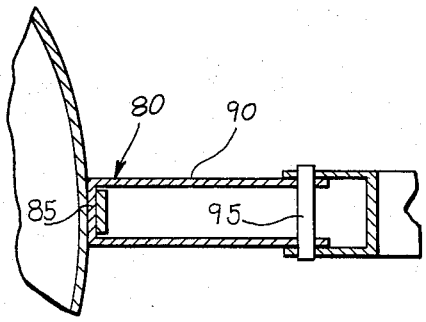
FIG. 4 is an enlarged fragmentary sectional view taken in the direction of line 4—4 of FIG. 3.

Each leg is provided at a generally medial portion thereof with an inwardly extending U-shaped strut 80. Each strut comprises at the inner end thereof a central bight portion 85 and extending generally radially outwardly from the ends of the bight portion, a pair of generally parallel leg portions 90. As best seen in FIG. 4, leg portions 90 are pivotally mounted to the leg sidewalls 75 as by a pin 95.

Figure 3:
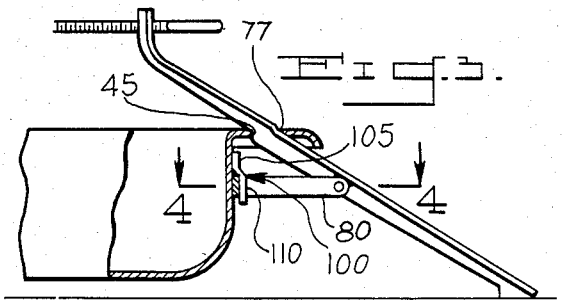
FIG. 3 is fragmentary view in partial section of the tree stand taken in the direction of line 3—3 in FIG. 2.

The strut bight portions engage sidewall 35 of the bowl, being located thereagainst by circumferentially spaced ears 100. As best illustrated in FIG. 3, each of the ears includes a mounting flange 105 at which the ear is secured to the bowl sidewall by any suitable technique and a tab portion 110 integral with and radially outwardly offset from the mounting flange for spacing from the sidewall. The bight portion of each of the struts is received within such spacing. The width of the spacings may be made less than the thickness of the strut bight portions whereby the bight portions are compressively held between the tabs and bowl sidewall by the inherent resilience of the tabs.

From the above description, it will be appreciated that the tree stand of the present invention is characterized by an economy of construction. The bowl may be formed by, for example, ordinary die forming of sheet metal or the like. Alternatively, the bowl may be manufactured from any of various known synthetic plastics by common molding techniques. Likewise, the legs and struts may be economically constructed from sheet metal by any of various known forming techniques, the channel and U-shape forms of these members imparting the requisite strength thereto.

Assembly and take-down of the tree stand is conveniently accomplished. In assembly, the legs are inserted in the apertures in the bowl rim with the locating surfaces of the legs in registry with the apertures. The struts are then pivoted upwardly for location of the bight portions thereof in engagement with the bowl sidewall between the sidewall and ear tabs. The tree is then inserted in the stand and the clamping bolts turned into engagement with the tree trunk whereby the trunk is gripped between the bolts. Engagement of the bolts with the trunk causes a radially outwardly directed reaction force to be applied to the legs, pivotally urging the inner leg ends outwardly about the edges of the apertures in the bowl rim. This causes the leg portions located outwardly of the bowl to be pivotally urged in a radially inward direction whereby the struts are urged inwardly into firm compressive engagement with the bowl sidewall. Such engagement of the screws with the tree trunk and struts with the bowl sidewall provides a rigid assembly for enhanced support and stabilization of the tree within the stand.

Having thus described the invention, what is claimed is:

1. A tree stand comprising a bowl for receiving a tree trunk therewithin, said bowl having a sidewall portion and a rim portion including a plurality of spaced apertures therein, said tree stand further comprising a plurality of legs extending through said apertures, said legs including inner end portions carrying means thereon for collectively clamping said tree trunk therebetween, said tree stand further comprising means extending radially inwardly from said legs and pivotally connected thereto and engaging said sidewall of said bowl, engagement of said clamping means with said tree trunk exerting outwardly directed reactive forces on the inner ends of said legs thereby pivotally urging said legs inwardly toward portions of said bowl rim portion adjacent said apertures and urging said sidewall engaging means radially inwardly into compressive engagement with said bowl at said sidewall portion thereof.

2. The tree stand of claim 1 wherein said bowl engaging means comprise generally radially extending struts, each including an outer end portion connected to a corresponding one of said legs and an inner end portion at which said strut engages said bowl sidewall portion.

3. The tree stand of claim 2 wherein each of said struts at said outer end portion thereof is pivotally connected to said corresponding one of said legs.

4. The tree stand of claim 2 wherein each of said legs is of channel shape including a central web portion and generally parallel sidewall portions extending from the sides of said web portion and wherein each of said struts is of generally elongate U-shape including a central bight portion and a pair of leg portions extending outwardly from the ends of said bight portion, said strut leg portions at free end portions thereof being pivotally connected to said legs at said sidewall portions thereof.

5. The tree stand of claim 2 wherein each of said legs is of channel shape including a central web portion and generally parallel sidewall portions extending from the sides of said web portion, said web portion, adjacent the aperture in said bown rim portion in which said leg is received, including a raised detent for providing enhanced retention of said leg within said aperture.

6. The tree stand of claim 2 wherein each of said legs is of channel shape including a central web portion and generally parallel sidewall portions extending from the sides of said web portion, radially inner and outer portions of the edges of said sidewalls being laterally offset from one another to define notches in said sidewall edges at said apertures for enhanced retention of said legs therewithin.

7. The tree stand of claim 2 wherein said bowl at said sidewall thereof has fixed thereto a plurality of spaced ears, each of said ears, with an adjacent portion of said bowl sidewall, locating therebetween one of said inner strut end portions.

8. The tree stand of claim 7 wherein each of said ears is resilient and provides with said bowl sidewall a compressive engagement therebetween of one of said strut inner end portions.

9. A tree stand comprising a bowl for receiving a tree trunk therewithin, said bowl having a sidewall and a rim portion including a plurality of spaced aperture in said rim portion, said tree stand including a plurality of legs engageable with said bowl rim portion, said legs including inner end portions extending through said apertures and carrying means thereon for collectively clamping said tree trunk therebetween and outer end portions adapted for engagement with a horizontal supporting surface, said tree stand further comprising means extending from said legs and pivotally connected thereto for compressively engaging said bowl sidewall when said legs are pivotally urged inwardly toward said bowl rim portion by outwardly directed reactive forces applied to said leg inner end portions by said tree trunk clamping means, said bowl sidewall having fixed thereto a plurality of ears, an inner end of each of said bowl engaging means being receivable between one of said ears and an adjacent portion of said bowl sidewall.

10. The tree stand of claim 9 wherein each of said ears includes a mounting flange fixed to said bowl and a tab portion spaced from said bowl sidewall, said tab portion extending from an edge of said mounting flange and being outwardly offset therefrom, said inner end of said bowl engaging means being restrained in a direction parallel to said sidewall by the juncture of said tab and said mounting flange.

11. A tree stand comprising a bowl for receiving a tree trunk therewithin, said bowl including a rim portion having a plurality of spaced apertures therein and a sidewall portion, a plurality of supporting legs extending through said apertures in said bowl rim portion and have inner end portions carrying means thereon for collectively clamping said tree trunk therebetween, said tree stand further comprising a plurality of struts, each being pivotally connected to a corresponding one of said legs at a medical portion thereof and compressively engageable with said bowl sidewall portion when said legs are pivotally urged inwardly toward said bowl rim portion by outwardly directed reactive forces applied to said leg inner end portions by said tree trunk clamping means.

12. The tree stand of claim 11 wherein each of said struts is of generally elongate U-shape including a central bight portion and a pair of leg portions extending outwardly from said bight portion at the ends thereof, each of said struts being connected to a corresponding one of said legs at the free ends of said strut leg portions.

* * * * *